US008176953B2

(12) United States Patent
Bertoli

(10) Patent No.: US 8,176,953 B2
(45) Date of Patent: May 15, 2012

(54) DEVICE TO DISPENSE FLUID PRODUCTS INTO A CONTAINER AND RELATIVE METHOD

(75) Inventor: Mirko Bertoli, Medolla (IT)

(73) Assignee: CPS Color Equipment Spa Con Unico Socio (IT)

( * ) Notice: Subject to any disclaimer, the term of this patent is extended or adjusted under 35 U.S.C. 154(b) by 698 days.

(21) Appl. No.: 12/299,326

(22) PCT Filed: May 3, 2007

(86) PCT No.: PCT/IB2007/001147

§ 371 (c)(1),
(2), (4) Date: Nov. 3, 2008

(87) PCT Pub. No.: WO2007/129190

PCT Pub. Date: Nov. 15, 2007

(65) Prior Publication Data

US 2009/0090740 A1 Apr. 9, 2009

(30) Foreign Application Priority Data

May 4, 2006 (IT) ..... UD2006A0117

(51) Int. Cl.
*B65B 1/04* (2006.01)

(52) U.S. Cl. ..... 141/329; 141/2

(58) Field of Classification Search ..... 141/329, 141/2, 21–27, 330; 239/271, 272, 309
See application file for complete search history.

(56) References Cited

U.S. PATENT DOCUMENTS

| | | | | |
|---|---|---|---|---|
| 5,882,601 | A | 3/1999 | Kath et al. | |
| 6,021,824 | A * | 2/2000 | Larsen et al. | 141/329 |
| 6,604,561 | B2 * | 8/2003 | Py | 141/329 |
| 7,140,401 | B2 * | 11/2006 | Wilcox et al. | 141/2 |
| 7,533,701 | B2 * | 5/2009 | Gadzic et al. | 141/54 |

FOREIGN PATENT DOCUMENTS

| | | | |
|---|---|---|---|
| EP | 1 174 701 | A1 | 1/2002 |
| EP | 1 439 000 | A | 7/2004 |
| FR | 2 767 583 | A | 2/1999 |
| GB | 1239346 | A | 7/1971 |

OTHER PUBLICATIONS

PCT Search Report dated Nov. 16, 2007 of Patent Application No. PCT/IB2007/001147 filed May 3, 2007.

* cited by examiner

*Primary Examiner* — Davis Hwu
(74) *Attorney, Agent, or Firm* — Maine Cernota & Rardin

(57) ABSTRACT

A device (10) to dispense fluid products into a container (12) provided with a closing portion (13) comprises delivery means (11) to deliver the fluid products into the container (12). The delivery means (11) comprises at least a tubular element (14) having a perforation end (34), by means of which the tubular element (14) perforates the closing portion (13) in order to make a delivery hole (16) in the closing portion (13) and is inserted, at least partly, into the container (12) in order to dispense at least one of the fluid products.

13 Claims, 3 Drawing Sheets

DEVICE TO DISPENSE FLUID PRODUCTS INTO A CONTAINER AND RELATIVE METHOD

RELATED APPLICATIONS

This application is a U.S. National Phase of PCT Application No. PCT/IB2007/001147, filed 3 May 2007, which claims the benefit of Italian Patent Applications No. UD2006A000117, filed 4 May 2006. Each of these applications is herein incorporated in its entirety by reference.

FIELD OF THE INVENTION

The present invention concerns a device to dispense fluid products, semi-fluid products, pastes, gels, creams, such as for example dyeing products, food products or other, into a closed container, and the relative dispensation method.

BACKGROUND OF THE INVENTION

Known dispensing or distribution machines for fluid products, such as for example dyes of different shades or color, creams of different taste or other, able to be metered and/or added to a base substance in order to form a paint or varnish or other fluid product, of a determinate color or taste, comprise a dispensation device equipped with a plurality of delivery nozzles, varying in number, from some units to some tens, which are grouped together in one or more delivery heads. Each delivery nozzle is connected to a corresponding tank of a determinate dye and is controlled by an electro-pump which allows the selective delivery of the fluid product in a suitably chosen quantity, for example with the aid of an electronic processor.

Said dispensation machines delivery the fluid products into a container, normally closed and sealed. The container normally consists of a can, tin or barrel or other, according to the quantity of fluid product contained. The container is provided with an upper closing portion, which can be perforated by means of a suitable perforation unit, in order to dispense the fluid products into the container, by means of the delivery nozzles.

Said known dispensation machines are also equipped with a sealing device, able to close the upper portion of the container when the fluid product has been dispensed.

However, said known dispensation machines are particularly complex, since they are provided both with a first translation device for the perforation unit, and with an actuator unit associated with the perforation unit in order to prevent the latter from interfering with the delivery nozzles for the fluid product, and also with a translation device for the sealing device, in order to move the latter between a position of non-interference with the delivery nozzles and a sealing position, in axis with said container, and vice versa.

The use of said dispensation machines also has the disadvantage that it requires both a step to translate the perforation unit on axis with the container, and also a subsequent step to displace the perforation unit, in order to allow the delivery nozzles to dispense.

Moreover, said known dispensation machines have the disadvantage that they need a step to align the holes of the container and the sealing device, and also a proper subsequent step to seal the container.

The perforation and the subsequent step of alignment and sealing also cause a slow-down in the dispensation operations.

Moreover, known dispensation machines often dirty the dispensation station, both because of an erroneous alignment with the container, and also because of the removal of the closing portion.

Finally, in the case of already perforated and sealed containers, a preliminary step is required to remove the seal or stopper from the container, before the dispensation operation; this removal contributes even more to increasing the time of the overall dispensation operation.

One purpose of the present invention is to achieve a dispensation device which allows to dispense fluid products into a container quickly, economically and cleanly, at the same time allowing to keep the closing portion of the container substantially sealed.

Another purpose is to perfect a method to dispense fluid products into a container which is quick and economical.

The Applicant has devised, tested and embodied the present invention to overcome the shortcomings of the state of the art and to obtain these and other purposes and advantages.

SUMMARY OF THE INVENTION

The present invention is set forth and characterized in the main claims, while the dependent claims describe other characteristics of the invention or variants to the main inventive idea.

In accordance with the above purposes, a dispensation device is able to dispense fluid products into a container provided with a closing portion.

Said dispensation device comprises delivery means, which is able to deliver said fluid products into said container.

According to a characteristic feature of the present invention, said delivery means comprises at least a tubular element having a perforation end.

Said at least one tubular element is able to perforate, by means of said perforation end, the closing portion of the container, in order to make a delivery hole in the closing portion. Said tubular element is also able to be inserted, at least partly, into said container through the closing portion in order to dispense at least one of said fluid products.

According to another characteristic feature of the present invention, said tubular element comprises an injection needle having an aperture for the passage of said fluid products, said aperture advantageously being positioned on the lateral surface of said tubular element, just above said perforation end. The latter is advantageously made pointed, so as to perforate the closing portion of the container.

Advantageously, by means of the present invention, a dispensation device is achieved that is effective and simplified in construction, since the delivery means, equipped with said tubular element, effect both the perforation of the container and also the dispensation of the fluid product, with considerable savings in components.

Thus, advantageously, the dispensation device, and in particular the tubular element, is parallel to the longitudinal axis of said container both during the perforation operation, and during the insertion of the tubular element and also during dispensation, thus obtaining a considerable reduction in the number of steps needed to effect said operations and in the time needed to carry out said steps, and also an increase in the cleanliness during said steps.

According to another form of embodiment of the present invention, said closing portion is made at least partly of an elastic material able to dilate, when said tubular element is inserted into said delivery hole, and to become compact again, that is, to close again, when said tubular element is removed from said delivery hole, in order to prevent the passage of said fluid products both towards the outside and also towards the inside of said container.

According to one form of embodiment of the present invention, said closing portion comprises a plurality of layers solidly associated with each other, which comprise at least a first layer made of said elastic material. Advantageously, said elastic material is polyurethane or other polymer material.

According to another form of embodiment of the present invention, said layers also comprise at least a second layer made of metal material disposed in sight of the user, which second layer advantageously functions as a visual indicator that the closing portion has or has not been perforated.

Therefore, with a reduced number of operations, in substance a perforation with relative insertion of the tubular element, a dispensation and a removal of the tubular element, we obtain a dispensation of the fluid products into the closed container, so that said container is closed, that is, with its closing portion substantially sealed, also at the end of said operations, without needing further sealing operations, without having to use auxiliary external closing elements and without having to restore the integrity of the closing portion with complex subsequent operations.

According to an advantageous feature of the present invention, the layer of elastic material of the closing portion tends to recover its shape, that is, the delivery holes made tend to close again, when it is perforated by said perforation end. The shape of the layer of elastic material is recovered advantageously when said tubular element is removed and no longer constitutes a physical impediment to the recovery of the shape.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
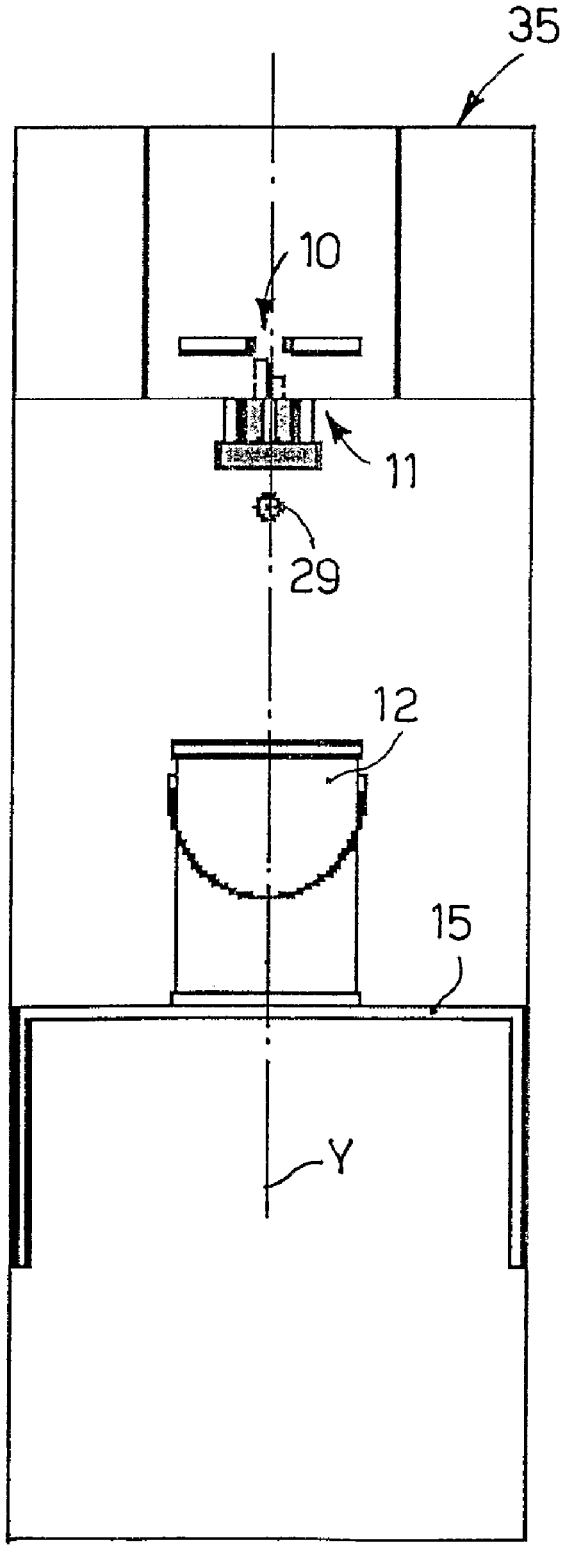
FIG. 1 is a schematic view of a device according to the present invention for automatically filling a container.

With reference to FIG. 1, a dispensation device 10 according to the present invention is used for automatically filling a container 12 for fluid products with a longitudinal axis Y, provided in this case with a lid having a closing portion 13 (FIGS. 2 and 9); the container 12 is made to advance along a feed line of a known type, for example using rollers or a conveyor belt.

The device 10 is able to operate with a dispensation apparatus 35, provided with a support 15 able to support and move the container 12, a horizontal movement device and a vertical movement device for the container 12, both known and not shown in the drawings.

A command and control unit is also provided, which is able to command and control, among other things, said horizontal and vertical movement devices. The command and control unit comprises for example an electronic calculator, or similar calculation device.

Said horizontal and vertical movement devices are driven by a motor that comprises an angular transducer or encoder, of a known type, able to signal the position of the support 15 to the command and control unit.

The vertical movement device also comprises presence sensor means 29 (FIGS. 1 and 2), cooperating with the command and control unit and able to detect the presence of the container 12 disposed in correspondence with the delivery nozzles 11 and able to signal to the command and control unit the presence of the container 12, for example in order to stop said motor during the ascent of the container 12, or to drive the dispensation.

In order to dispense the fluid products, the device 10 comprises a plurality of delivery nozzles 11, which are able to deliver the fluid products into the container 12.

Figure 2:
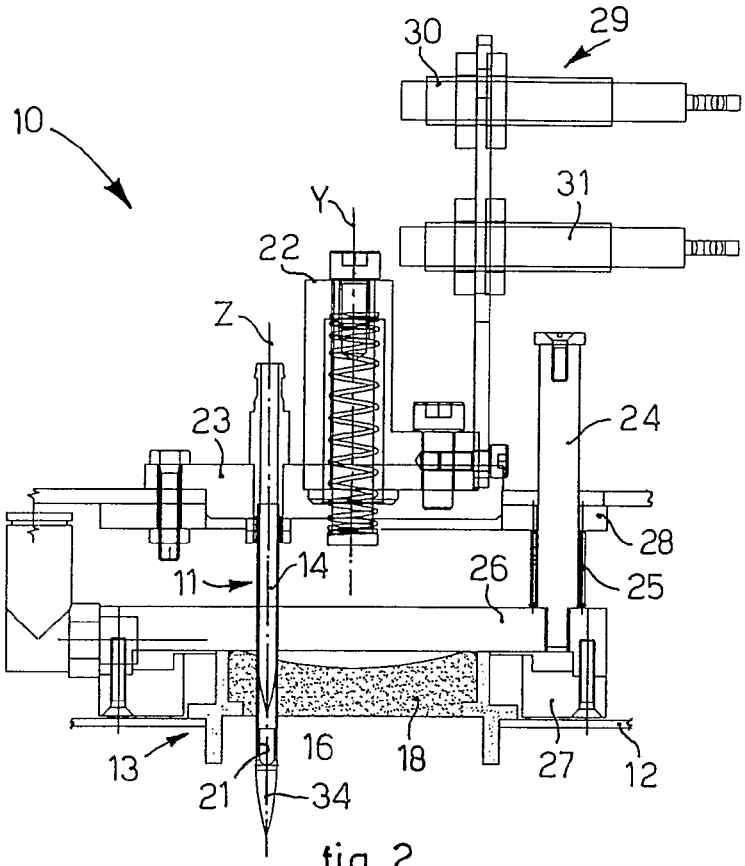
FIG. 2 is a section view of the device in FIG. 1.
Figure 3:
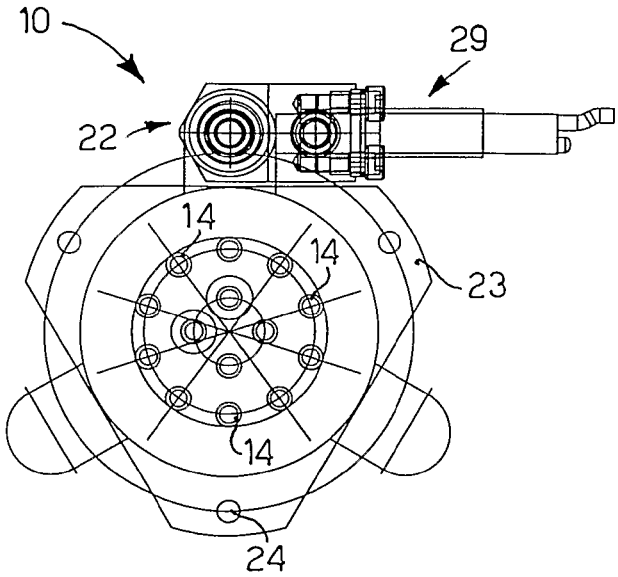
FIG. 3 is a plane view of the dispensation device in FIG. 2.

The delivery nozzles 11 are supported at the upper part by a platelet 23 and a support element 28, which cooperate with a protection element 26 made for example of metal or plastic material, coaxial with the plurality of delivery nozzles 11, outside the latter, and constrained to vertical guide pins 24, free to slide vertically (FIGS. 2 and 3).

On each of the guide pins 24 corresponding springs 25 (FIG. 2) are mounted, which hold the protection element 26 thrust downward.

The protection element 26 is also associated with an anti-drying device, of a known type, comprising a humidification platelet 27 which, cooperating with a closing element, not shown in the drawings, is able to achieve an environment with a controlled atmosphere, in particular having a pre-determined level of relative humidity, so as to prevent the fluid products from drying out in proximity with the outlets of the delivery nozzles 11.

According to a characteristic feature of the present invention, each of said delivery nozzles 11 consists, in substance, of a tubular element 14 or injection needle, with a longitudinal axis Z parallel in normal use to said axis Y of the container 12, able both to perforate said closing portion and also to be inserted, at least partly, into said container, so as to dispense at least one of the fluid products.

Figure 4:
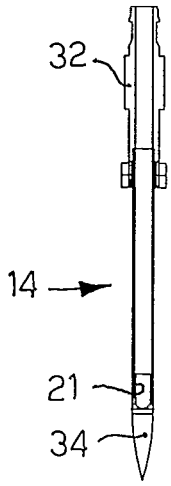
FIG. 4 is a view of a part of the dispensation device in FIG. 2.
Figure 7:
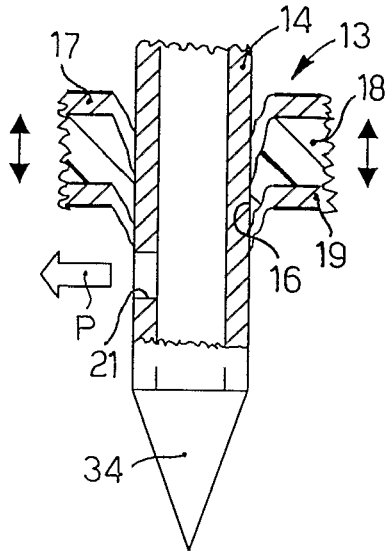
FIG. 7 is a schematic representation of the closing portion in FIG. 5 cooperating with the part shown in FIG. 4 of the dispensation device.
Figure 8:
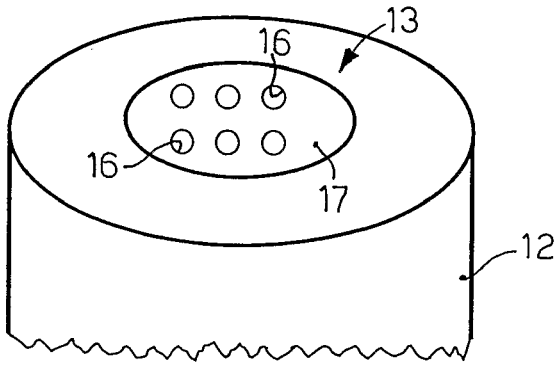
FIG. 8 is a schematic representation of a part of the container in FIG. 1.

Each tubular element 14 or needle is provided with an upper delivery pipe 32, usually made of plastic material, connected to a pointed lower part 34 (FIG. 4), which is able to perforate the material which the closing portion 13 is made of, in order to make a delivery hole 16 (FIGS. 2 and 8). The fluid product is thus made to flow through the delivery pipe 32 inside the container 12. To this end, the needle 14 has an aperture 21, advantageously a plurality of apertures 21, preferably made in the lateral surface of the needle 14, slightly above the pointed part 34, for the passage of a flow P of fluid product (FIG. 7).

The needles 14 are disposed in an area substantially identical to the area of said closing portion 13, so as to perorate the latter uniformly and achieve a plurality of delivery holes 16.

To this end, the container 12 is aligned and lifted upward, by means of said horizontal and vertical movement devices, towards the plurality of needles 14, which then perforate the closing portion 13.

The needles 14 are thus at least partly inserted into the container 12 through the delivery holes 16, to dispense said fluid products.

The entity by which the container 12 is lifted is controlled by means of said sensor means 29, in this case comprising a first upper proximity sensor 30 and a second lower proximity sensor 31. The latter cooperate with a perforation control unit 22, comprised in the command and control unit, which thus functions as an indicator element.

The sensor means 29 supplies at least a signal indicating the presence or absence of the container 12, which signal is processed by the command and control unit. The latter thus commands the start and stop of the vertical travel of the container 12 and the dispensation of fluid products.

According to an alternative embodiment of the present invention, perforation may also be effected by moving the needles 14 towards the container 12, using a mobile delivery head.

According to another characteristic feature of the present invention, the closing portion 13 of the container 12 is made of at least a material able to dilate (FIG. 7), when said tubular element 14 is inserted into said delivery hole 16, to allow the passage of the fluid product injected inside the container 12, and to become compact again, that is, to close again, when said tubular element 14 is removed from the delivery hole 16, to prevent the passage of the fluid products both towards the outside and also towards the inside of the container 12.

Figure 5:
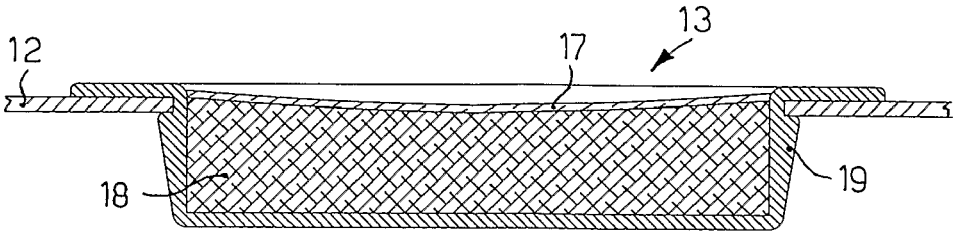
FIG. 5 is a section view of a closing portion of the container for fluid products in FIG. 1, according to the present invention.
Figure 6:
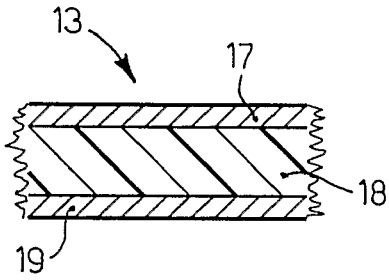
FIG. 6 is a schematic representation of the closing portion in FIG. 5.

Advantageously, the closing portion 13 comprises a plurality of layers 17, 18, 19 or sheets, solidly associated with each other (FIGS. 5 and 6).

To be more exact, the layers 17, 18, 19 comprise at least a first layer 18 of elastic material, for example made of polyurethane material, such as a polyurethane foam, silicon rubbers, natural rubber, or other polymer materials having chemical-physical characteristics such as to allow said layer 18, when perforated for example by means of needles with a diameter, also axially variable, comprised between about 1 and 5 mm, to dilate and subsequently recover the deformation due to the perforation, so as to be substantially intact and homogeneous also after the perforation, and to prevent, in this case, the fluid products from leaking from the container 12.

According to another characteristic feature of the present invention, the sheets 17, 18, 19 also comprise at least a second layer 17 of metal material, such as for example aluminum or other, functioning as a visual signal that perforation has occurred. Alternatively, the second layer 17 can be made of plastic material.

According to another characteristic feature of the present invention, the sheets 17, 18, 19 also comprise at least a third layer 19 of plastic, non-elastic polymer material, advantageously having a structural function for the closing portion 13.

The device 10 as described heretofore is able to function according to a method that comprises the following steps.

During a first step of horizontal movement, the support 15, by means of the horizontal movement device, is removed frontally from the dispensation apparatus 35 to allow the container 12 to be positioned on the support 15 and, subsequently, reinserted inside the apparatus 35 (FIG. 1).

After the horizontal movement step, there follows a perforation step a), during which the closing portion 13 is perforated by means of the needles 14.

During the perforation step a) an insertion step b) is also effected, in which the container 12 is lifted toward the needles 14, or vice versa, at a speed that varies according to the size of the delivery holes 16 to be made, the characteristics of the material of the container 12 and the size of the container 12. During this insertion step b) the needles 14 are at least partly inserted into the closing portion 13 and thus the delivery holes 16 are made on the closing portion 13 of the container 12 (FIG. 7).

After the insertion step b) there follows a dispensation step c), during which the command and control unit drives the injection needles 14, at least partly inserted into the closing portion 13, so that the aperture 21 is inserted into the container 12 in order to dispense the pigments or other substances into the container 12 through the delivery hole 16, determined according to the type of pigment to be delivered.

During the perforation step a), the insertion step b) and the dispensation step c), the longitudinal axis Z of each of the needles 14 is advantageously parallel to the longitudinal axis Y of the container 12. The needles 14 may also not be centered with respect to the container 12, but remain parallel to the axis Y of the container, thus avoiding the plurality of translations that are made in the state of the art.

After the dispensation step c) there follows a removal and distancing step, during which the support 15 and the container 12 are distanced from the delivery nozzles 11, or vice versa.

Subsequently, and in a short time, it is thus possible to proceed with the dispensation of fluid products into another container 12, avoiding disadvantageous translations and/or rotations of the perforation, dispensation and sealing units as in the state of the art.

After the delivery nozzles 11 have been removed from the closing portion 13, the delivery holes 16 substantially reclose (FIG. 8), thanks to the ability of the sheet 18 of plastic material to regain its shape.

Thus, advantageously, it is possible to eliminate the sealing step from the functioning of the device 10, as occurs on the contrary in the state of the art.

It is clear that modifications and/or additions of parts may be made to the dispensation device 10 as described heretofore, without departing from the field and scope of the present invention.

It is also clear that, although the present invention has been described with reference to some specific examples, a person of skill in the art shall certainly be able to achieve many other equivalent forms of dispensation device, having the characteristics as set forth in the claims and hence all coming within the field of protection defined thereby.

The invention claimed is:

1. A device to dispense fluid products into a container, said device comprising: a closing portion, the device comprising delivery means for delivering said fluid products into said container, wherein said delivery means comprises at least a tubular element having a perforation end, said at least one tubular element being able both to perforate, by means of said perforation end, said closing portion in order to make a delivery hole in said closing portion, and also to be inserted, at least partly, into said container in order to dispense at least one of said fluid products, wherein said tubular element comprises an injection needle having at least an aperture for the passage of said fluid products, wherein said perforation end is a solid point disposed at a lower end of said tubular element, said solid point being rotationally symmetrical around a center axis and wherein said aperture is positioned on the lateral surface of said tubular element, just above said perforation end.

2. The device as in claim 1, wherein said closing portion is made at least partly of an elastic material able to dilate, when said tubular element is inserted into said delivery hole, and to become compact again when said tubular element is removed from said delivery hole, in order to prevent the passage of said fluid products both towards the outside and also towards the inside of said container.

3. The device as in claim 2, wherein said closing portion comprises a plurality of layers solidly associated with each other and wherein said layers comprise at least a first layer made of said elastic material.

4. The device as in claim 3, wherein said layers also comprise at least a second layer made of metal material.

5. The device as in claim 3, wherein said layers also comprise at least a second layer made of plastic material.

6. The device as in claim 3, wherein said layers also comprise at least a third layer made of non-elastic plastic polymer material.

7. The device as in claim 3, wherein said delivery means comprises a plurality of tubular elements disposed in an area substantially identical to that of said closing portion, to simultaneously achieve a plurality of delivery holes.

8. The device as in claim 2, wherein said elastic material comprises polyurethane or other polymer material.

9. The device as in claim 1, comprising a perforation control unit able to cooperate with sensor means in order to control the perforation of said container and the dispensation of said fluid products.

10. A method to dispense fluid products into a container provided with a closing portion, by means of delivery means for said fluid products, the method comprising:

a) at least a perforation step to perforate said closing portion by inserting said delivery means, comprising at least a tubular element having a solid perforation end, and an aperture positioned on the lateral surface of said tubular element, just above said perforation end;

b) at least an insertion step, in which at least part of said tubular element is inserted into said container through said closing portion;

c) at least a dispensation step to dispense at least one of said fluid products into said container by means of said tubular element and through said lateral aperture; and wherein said perforation end is rotationally symmetrical around a center axis.

11. The method as in claim 10, wherein said at least one tubular element has a longitudinal axis (Z) which, during said perforation, insertion and dispensation steps, remains substantially parallel to the axis (Y) of said container.

12. The method as in claim 10, also comprising a step to remove said at least one tubular element from said closing portion so as to proceed with the dispensation of at least one of said fluid products into another container.

13. The method as in claim 10, further comprising a preliminary step of preparation of said closing portion by means of a plurality of layers solidly associated with each other, wherein at least a first layer of said plurality of layers is made of elastic material.

* * * * *